US005223667A

United States Patent [19]

Anderson

[11] Patent Number: 5,223,667

[45] Date of Patent: Jun. 29, 1993

[54] PLURAL PIECE FLECHETTES AFFORDING ENHANCED PENETRATION

[75] Inventor: Richard V. Anderson, Arlington, Tex.

[73] Assignee: BEI Electronics, Inc., San Francisco, Calif.

[21] Appl. No.: 822,349

[22] Filed: Jan. 21, 1992

[51] Int. Cl.[5] ..... F42B 10/08; F42B 12/06

[52] U.S. Cl. ..... 102/517; 102/519; 102/703; 244/3.3; 273/420; 273/423

[58] Field of Search ..... 102/517-519, 102/521, 703; 244/3.24, 3.3; 273/416, 419, 420, 423

[56] References Cited

U.S. PATENT DOCUMENTS

| | | | |
|---|---|---|---|
| 2,343,344 | 3/1944 | Thompson | 102/517 |
| 3,515,072 | 6/1970 | Barr | 102/703 |
| 3,995,861 | 12/1976 | Clarke | 273/423 |
| 4,643,099 | 2/1987 | Luther et al. | 102/517 |
| 4,716,834 | 1/1988 | Wallow et al. | 102/519 |
| 4,733,612 | 3/1988 | Sigg | 102/521 |
| 4,779,536 | 10/1988 | Luther et al. | 102/517 |

FOREIGN PATENT DOCUMENTS

| | | | |
|---|---|---|---|
| 329029 | 8/1936 | Italy | 102/517 |
| 360312 | 3/1962 | Switzerland | 102/517 |
| 2071825 | 9/1981 | United Kingdom | 244/324 |

OTHER PUBLICATIONS

PCT WO 88/07169, Smith et al., Sep. 22, 1988.

An actual printed copy of a prior art leaflet or brochure published by BEI Defense Systems Company, Inc. and entitled: 70 mm M255 Flechette Warhead.

*Primary Examiner*—Harold J. Tudor

*Attorney, Agent, or Firm*—Palmatier & Zummer

[57] ABSTRACT

A flechette is disclosed comprising a rod-shaped steel body having a blunt generally conical penetrating point, a separate resinous plastic fin component securely mounted on the rear end portion of the body, and a generally conical gradually tapering resinous plastic nose piece securely mounted on the penetrating point for reducing air drag when the flechette is fired at high velocity. Interlocking annular flanges are formed on the penetrating point and the nose piece for securing the nose piece to the body. The fin component has an axial sleeve received around a rear pin portion of the body and securely retained thereon by annular flange and groove members on the sleeve and the rear pin portion. A modified flechette is disclosed having a separate, hardened steel penetrator component securely mounted on a reduced front pin member on the body by a press fit between the front pin member and a rearwardly opening bore in the penetrator component. A blunt conical penetrating point is formed on the penetrating component. Preferably, a gradually tapering, generally conical nose piece is securely mounted on the point of the penetrator component for reducing air drag. Interlocking annular flanges are provided on the nose piece and the penetrating point for securing them together.

8 Claims, 2 Drawing Sheets

PLURAL PIECE FLECHETTES AFFORDING ENHANCED PENETRATION

FIELD OF THE INVENTION

This invention relates to military flechettes which generally take the form of small dart-like projectiles adapted to be fired at high velocity from a gun or warhead.

BACKGROUND OF THE INVENTION

The U.S. Army currently uses two standard flechettes, comprising the 60-grain flechette and the 120-grain flechette. These flechettes are loaded into rocket warheads and are intended for use against personnel, material, equipment and aircraft. Flechettes carried by rocket warheads are especially advantageous when used by friendly aircraft against enemy aircraft. However, enemy aircraft are generally provided with light armor for protecting vital spots. Standard flechettes will not penetrate the armor, because the standard flechettes break into several pieces when the flechettes strike the hardened surface of the armor. The standard flechette construction utilizes a sharp nose point to achieve low air drag when the flechette is fired at a high velocity. However, the impact of the sharp nose point with hardened armor causes the point to break and initiates shock waves that break up the rest of the flechette, so that penetration is not achieved.

The standard flechette is also very expensive to fabricate. The standard flechette is generally made in one piece from tough hard medium carbon steel in the form of rod stock. The flechette has fins which are cold formed in a press at high pressure by very expensive dies which wear quickly. The sharply pointed nose is then machined by a separate operation.

OBJECTS OF THE INVENTION

One object of the present invention is to provide a new and improved flechette which achieves enhanced penetration in that the flechette does not break up upon impact with surface-hardened armor but rather penetrates considerable thicknesses of the armor.

A further object is to provide a new and improved flechette of the foregoing character which also achieves low air drag.

Another object of the present invention is to provide a new and improved flechette of the foregoing character which is easy and inexpensive to fabricate.

SUMMARY OF THE INVENTION

To achieve these and other objects, the present invention preferably provides a flechette for use as a military projectile, comprising an elongated, generally rod-shaped body made of a tough metallic material and having front and rear end portions, fin means forming a plurality of guide fins on the rear end portion, point means forming a blunt penetrating point on the front end portion, an elongated, generally conical nose piece made of resinous plastic material and mounted on the front portion for reducing air drag on the flechette, and connecting means for securing the nose piece to the point means.

Preferably, the body is generally cylindrical in shape.

The connecting means preferably comprise first and second interlocking annular flanges on the penetrating point and the nose piece, respectively.

Preferably, each of the interlocking flanges is generally barb-shaped in cross section for snapping together when the nose piece is pushed into place on the penetrating point.

The blunt penetrating point preferably has a blunt, forwardly projecting, generally conical end surface, the first annular flange being formed on such end surface. The nose piece preferably has a rearwardly-facing recess formed with an internal, generally conical surface for engaging the external, generally conical surface on the penetrating point, the second annular flange being formed on the internal, generally conical surface on the nose piece.

The blunt penetrating point preferably has an abruptly tapering, generally conical front end surface, the nose piece having an external, generally conical surface tapering substantially more gradually than the generally conical surface of the penetrating point for reducing air drag on the flechette.

In an alternative embodiment, the point means comprise a separate penetrator component securely mounted on the front end portion of the body, the blunt penetrating point being formed on the penetrator component, the nose piece being mounted on the penetrator component.

In the alternative embodiment, the point means preferably comprise a separate penetrator component securely mounted on the front end portion of the body, the blunt penetrating point being formed on the penetrator component and having a generally conical surface tapering abruptly in a forward direction, the nose piece being mounted on the penetrator component and having a generally conical surface tapering in a forward direction and substantially more gradually than the generally conical surface of the penetrating point to reduce air drag on the flechette.

Preferably, the penetrator component is made of a tough hard metallic material, which preferably takes the form of a tough hard alloy steel.

The penetrator component is preferably in the form of a cap having a rear portion with a bore therein for receiving the front end portion of the body with a press fit.

The front end portion of the body preferably has a reduced, generally cylindrical pin portion, the penetrator component preferably being in the form of a cap having a rear portion with an axial bore therein for receiving the pin portion with a press fit.

Preferably, the fin means comprise a fin component securely mounted on the rear end portion of the body, the fin component being made of a moldable resinous plastic material.

The fin component preferably comprises an axial sleeve member having an axial opening therein for receiving the rear end portion of the body, the guide fins being formed in one piece with the sleeve member.

The flechette preferably includes interlocking elements on the sleeve member and the body for securely retaining the fin component on the body.

The rear end portion of the body is preferably formed with a reduced rear pin portion for secure retention in the opening in the sleeve member.

Interlocking flange and groove elements are preferably provided on the sleeve member and on the reduced rear pin portion of the body for securely retaining the fin component on the body.

In another aspect, the present invention may provide a flechette for use as a military projectile, comprising an elongated, generally rod-shaped body made of a tough metallic material and having front and rear end portions, point means forming a penetrating point on the front end portion of the body, and fin means forming a plurality of guide fins on the rear end portion of the body, the fin means comprising a fin component securely mounted on the rear end portion of the body, the fin component being made of a moldable resinous plastic material.

The fin component preferably comprises an axial sleeve member having an axial opening therein for receiving the rear end portion of the body, the guide fins being formed in one piece with the sleeve member.

Interlocking elements are preferably provided on the sleeve member and the body for securely retaining the fin component on the body.

The rear end portion of the body is formed with a reduced rear pin portion for secure reception in the opening in the sleeve member.

Preferably, interlocking flange and groove elements are provided on the sleeve member and on the reduced rear pin portion of the body for securely retaining the fin component on the body.

In still another aspect, the present invention preferably provides a flechette for use as a military projectile, comprising an elongated, generally rod-shaped body made of a tough metallic material and having front and rear end portions, fin means forming a plurality of guide fins on the rear end portion, and point means forming a blunt penetrating point on the front end portion of the body, the point means comprising a separate penetrator component securely mounted on the front end portion of the body, the blunt penetrating point being formed on the penetrator component.

Preferably, the penetrator component is made of a tough hard metallic material having a hardness exceeding the hardness of the body material.

More specifically, the penetrator component is preferably made of a tough hard alloy steel having a hardness exceeding the hardness of the material of the body.

The penetrator component is preferably in the form of a cap having a rear portion with an axial bore therein for securely receiving the front end portion of the body.

Preferably, the penetrator component is in the form of a cap having a rear portion with an axial bore therein for securely receiving the front end portion of the body with a press fit.

The front end portion of the body preferably has a reduced generally cylindrical pin portion, the penetrator component being in the form of a cap having a rear portion with an axial bore therein for securely receiving the pin portion with a press fit.

The fin means preferably comprises a fin component securely mounted on the rear end portion of the body, the fin component being made of a moldable resinous plastic material, the guide fins being formed in one piece with the fin component.

BRIEF DESCRIPTION OF THE DRAWINGS

Further objects, advantages and features of the present invention will appear from the following description, taken with the accompanying drawings, in which.

DETAILED DESCRIPTION OF ILLUSTRATIVE EMBODIMENTS

Figure 1:
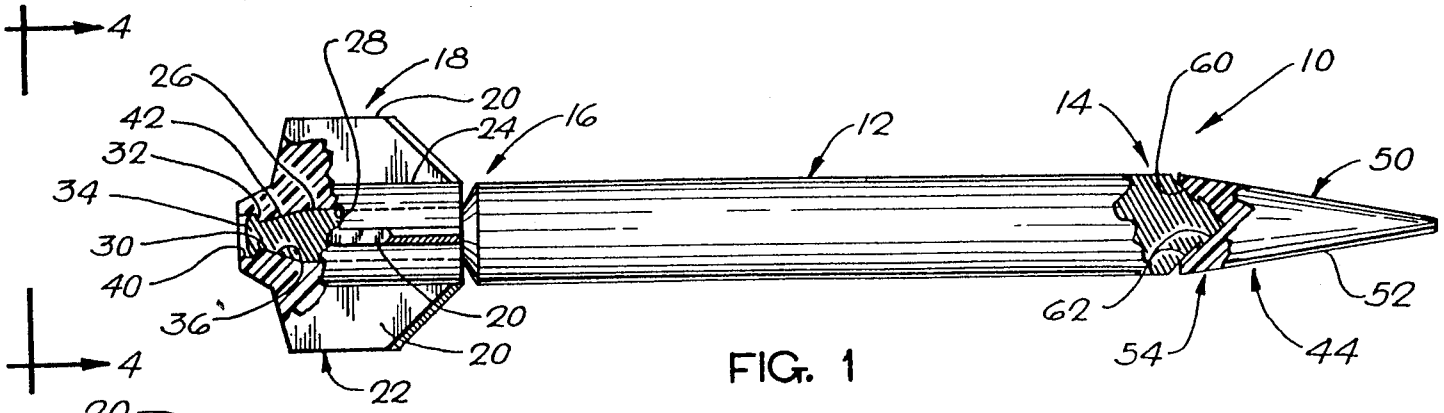
FIG. 1 is an enlarged side elevational view of a flechette to be described as a first illustrative embodiment of the present invention, the view being partly in section, taken along a central longitudinal plane.

Referring more specifically to the drawings, FIGS. 1–4 illustrate a flechette 10 to be described as a first illustrative embodiment of the present invention. The flechette 10 is dart-like in shape and is intended for use as a military projectile, adapted to be fired at a high velocity from a gun or a warhead. The flechette 10 has a plural piece construction, comprising an elongated, generally rod-shaped body 12 which is illustrated as being generally cylindrical in shape. The body 12 is made of a tough metallic material, preferably a tough medium or high carbon steel, such as standard flechette stock. The body 12 has front and rear end portions 14 and 16, respectively.

The flechette 10 comprises fin means 18 forming a plurality of guide fins 20 on the rear end portion 16 of the body 12. Four of the fins 20 are provided, as shown to best advantage in FIG. 4, but a different number of fins may be employed, if desired.

In accordance with one feature of the present invention, the fin means 18 preferably take the form of a separate fin component 22, which may also be referred to as a tail piece, securely mounted on the rear end portion 16 of the body 12. Preferably, the fin component 22 is made of a moldable resinous plastic material, such as glass filled nylon or some other sturdy plastic material, preferably filled with glass fibers.

The illustrated fin component 22 comprises an axial sleeve member 24. The fins 20 are molded in one piece with the sleeve member 24.

The rear end portion 16 of the body 12 is preferably formed with a reduced rear pin portion 26. The sleeve member 24 is formed with an axial opening 28 for receiving the reduced rear pin portion 26, which may also be referred to as a reduced tail boom on the rear end of the body 12.

Figure 2:
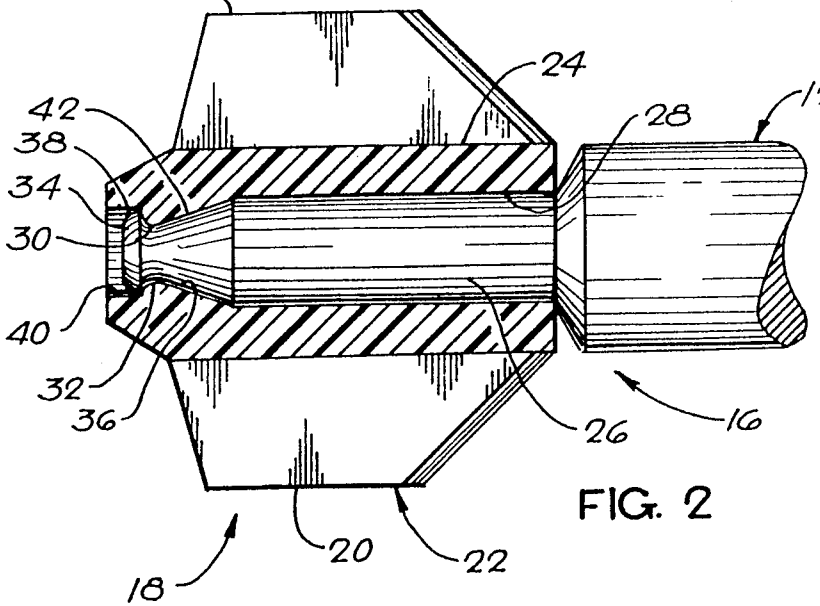
FIG. 2 is a greatly enlarged fragmentary elevational view of the rear portion of the flechette, showing the fin component in a fragmentary section, taken along a central longitudinal plane.
Figure 3:
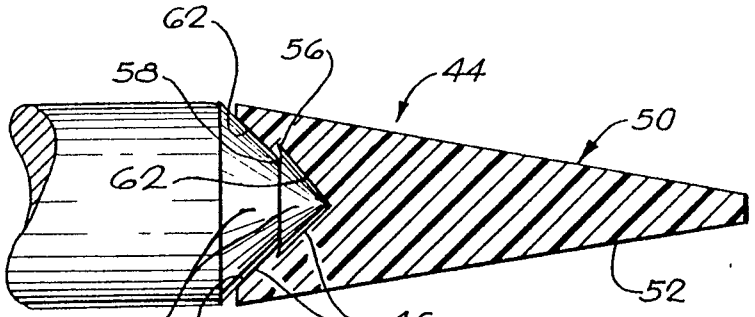
FIG. 3 is a greatly enlarged elevational view of the front portion of the flechette, showing the nose piece in a central longitudinal section.

Interconnecting elements are provided on the sleeve member 24 and the reduced pin portion 26, whereby the fin component 22 is securely mounted on the rear portion 16 of the body 12. Such interconnecting elements are illustrated as interlocking annular flange and groove elements 30 and 32. As shown to best advantage in FIG. 2, the annular flange element 32 projects inwardly on the axial sleeve 24, near the rear end of the axial opening 28. The annular groove element 32 is formed in the reduced pin portion 26, near the rear end thereof. The formation of the annular groove 32 produces a circular flange or knob 34 at the rear end of the reduced pin portion 26. The annular flange element 32 is formed with an internal annular ramp 36, adapted to be engaged by a smoothly rounded rear portion 38 of the knob 34. The resinous plastic material of the sleeve member 24 is sufficiently elastic to provide for the assembly of the fin component 22 and the body 12 by exerting axial pressure between the body 12 and the fin component 22, so as to force the knob 34 to slide rearwardly along the annular ramp 36, whereby the rear portion of the sleeve member 24 is elastically expanded to allow the knob 34 to move rearwardly past the internal annular flange element 30, until the knob 34 is positioned to the rear of the flange element 30, while the flange element is received in the annular groove element 32, formed in the reduced pin portion 26, as shown in FIGS. 1 and 2. The fin component 22 is very securely retained on the rear portion 16 of the body 12 by the interlocking engagement between the internal annular flange element 30 and the combination of the annular groove element 32 and the knob 34 on the reduced rear pin portion 26 of the body 12.

When the fin component 22 is fully assembled on the reduced pin portion 26, the knob 34 is received in a rearwardly facing axial recess 40, formed in the sleeve member 24 to the rear of the internal annular flange element 30. The axial depth of the recess 40 is greater than the axial length of the knob 34 so that the knob 34 is fully contained within the recess 40, when the fin component 22 is fully assembled on the rear portion 16 of the body 12. Thus, the knob 34 cannot interfere with the application of the necessary pressure to the fin component 22, in order to bring about the full assembly of the fin component on the reduced rear pin portion 26 of the body 12.

As shown in FIG. 2, the reduced rear pin portion 26 is formed with a rearwardly tapering external frustoconical surface 42 which is engagable with the internal annular ramp 36 on the fin component 22, so as to secure the fin component 22 against forward movement when the fin component is fully assembled on the reduced rear pin portion 26. Thus, any looseness of the fin component 22 is avoided.

The flechette 10 is also provided with point means 44 forming a blunt penetrating point 46 on the front end portion 14 of the body 12. The blunt penetrating point 46 comprises an external, generally conical surface 48 which tapers abruptly. As shown in FIGS. 1 and 2, the conical surface 48 has an apex angle of approximately 90°, but this angle may be varied. Due to its bluntness, the penetrating point 46 is adequately supported by the body 12, so that the penetrating point 46 is able to penetrate light armor, such as that employed in aircraft to protect vital components. Because of the bluntness of the point 46, the impact of the point with armor or other hard material does not cause the point 46 or the body 12 to shatter. Such shattering is often experienced by the sharply pointed flechettes of the prior art.

The penetrating point 46 and the adjacent front portion 14 of the body 12 is preferably case hardened or hardened by heat treatment or otherwise, so as to enhance the ability of the point 46 to penetrate armor and other hard targets. The conical surface 48 of the penetrating point 46 may be machined by automatic machinery, such as an automatic screw machine, prior to the hardening of the point 46. The body 12 may be made of cylindrical rod stock. The reduced rear pin portion 26 of the body 12 may also be machined by automatic machinery, such as an automatic screw machine.

The flechette 10 may be used as a military projectile in the form as already described, without the addition of any component, but the bluntness of the penetrating point 46 increases the air drag or friction experienced by the flechette when it is fired at a high velocity. The air drag produced by the blunt penetrating point 46 is significantly greater than the air drag produced by the comparatively sharper point of a conventional flechette.

To reduce the air drag, the front end portion 14 of the flechette 10 is provided with an elongated, generally conical nose piece 50 which is substantially more sharply pointed than is the blunt penetrating point 46. The nose piece 50 is made of a sturdy lightweight material, such as glass filled nylon or some other suitable resinous plastic material. The nose piece 50 has an external generally conical surface 52 which is substantially more gradually tapered than is the external generally conical surface 48 of the blunt penetrating point 46. The sharply pointed shape of the nose piece is comparable to the shape of the nose portion of a conventional flechette made in one piece of steel. As shown, the external generally conical surface 52 has an apex angle of approximately 20°, but such angle may be varied while still achieving the desired reduction in air drag.

The flechette 10 is provided with connecting means 54 for securing the nose piece 50 to the front end portion 14 of the body 12. As shown, the connecting means 54 comprise first and second interlocking annular flanges 56 and 58 on the penetrating point 46 and the nose piece 50, respectively. Each of the illustrated flanges 56 and 58 is generally barb-shaped in cross section so that the flanges will snap together when the nose piece 50 is pushed into place on the penetrating point 46. The flange 58 and the adjacent portions of the nose piece 50 are sufficiently flexible and elastic to enable the flange 58 to flex outwardly and then to spring inwardly behind the flange 56 when the nose piece 50 is pushed rearwardly against the penetrating point 46. As shown, the first annular flange 56 is formed on the external generally conical surface 48 of the blunt penetrating point 46. The nose piece 50 is formed with a rearwardly facing recess 60 having an internal, generally conical surface 62 for engaging the external, generally conical surface 48 of the penetrating point 46. The second annular flange 58 is formed on the internal, generally conical surface 62 and is molded in one piece with the nose piece 50.

When the flechette 10 is fired at a high velocity against a target, the nose piece 50 strikes the target and shatters easily so that the nose piece does not interfere with the direct impact of the penetrating point 46 with the target. The blunt penetrating point 46 is adequately supported by the body 12 so that the impact causes the blunt penetrating point 46 to penetrate the target, without causing the body 12 to break up.

As illustrated to best advantage in FIG. 2, the external generally conical surface 48 on the blunt penetrating point 46 is stepped slightly because of the provision of the external annular flange 56 on the point 46. Similarly, the internal generally conical surface 62 in the rearwardly facing recess 60 in the nose piece 50 is slightly stepped, because of the provision of the second annular flange 58. When the nose piece 50 is fully assembled on the front end portion 14 of the body 12, the external generally conical surface 48 is fully engaged with the internal generally conical surface 62, and the first and second flanges 56 and 58 are in full interlocking engagement.

Figure 5:
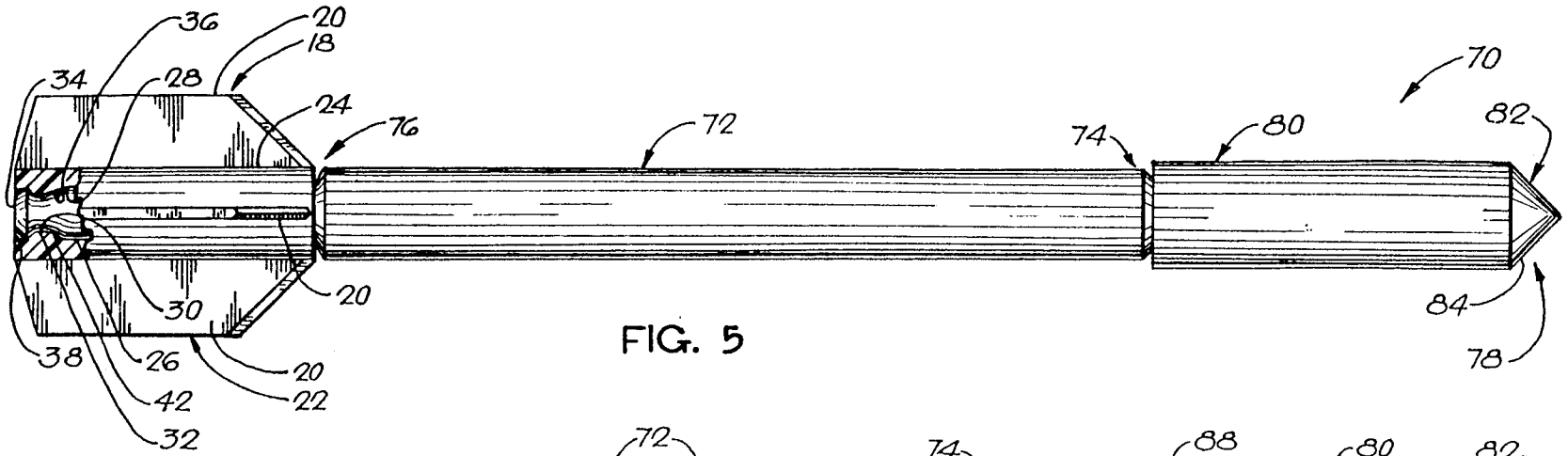
FIG. 5 is an enlarged elevational view of a modified flechette, to be described as a second illustrative embodiment of the present invention.
Figure 6:
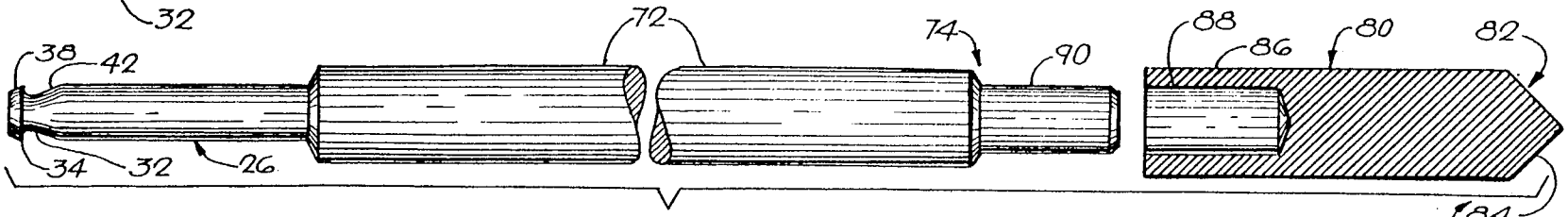
FIG. 6 is a fragmentary, partial exploded view of the flechette of FIG. 5, the penetrator component being shown in a central longitudinal section.

FIGS. 5 and 6 illustrate a modified flechette 70 to be described as a second illustrative embodiment of the present invention. The modified flechette 70 has a generally cylindrical, rod-shaped body 72 having front and rear end portions 74 and 76, respectively. The rear end portion 76 is substantially the same as the rear end portion 16 of the flechette 10 already described and illustrated in FIGS. 1-4. Moreover, all of the components on and associated with the rear end portion 16 are the same as previously described and illustrated. To avoid a repetitive description, the same reference characters, previously applied to FIGS. 1-4, have been applied to FIGS. 5 and 6, so that the previous description will be fully applicable to such components.

The components of the modified flechette 70 which are the same as previously described include the fin means 18, the guide fins 20, the fin component 22, the axial sleeve member 24, the reduced rear pin portion 26, the axial opening 28 in the sleeve member 24, the interlocking annular flange and groove elements 30 and 32, the circular flange or knob 26, the internal annular ramp 36, the smoothly rounded rear portion 38 of the flange 34, the rearwardly facing axial recess 40, and the rearwardly tapering external frustoconical surface 42 on the reduced rear pin portion 26.

The modified flechette 70 of FIGS. 5 and 6 includes modified point means 78 comprising a separate penetrator component 80 securely mounted on the front end portion 74 of the body 72. The penetrator component 80 has a blunt penetrating point 82, illustrated as comprising a generally conical surface 84 on the front end of the penetrator component 80. The conical surface 84 is shown as having an apex angle of approximately 90°, but this angle may be varied while still achieving the desired penetrating action.

The modified body 72 may be made of a tough metallic material of medium hardness, preferably standard flechette stock, generally comprising a tough medium carbon steel.

The penetrator component 80 may be made of a tough hard metallic material having a hardness exceeding the hardness of the body material. Preferably, the penetrator component is made of a tough very high alloy hardenable steel having an ultimate hardness greatly exceeding the hardness of the body material, after the penetrator component 80 is hardened by a known or suitable heat treatment procedure.

As illustrated, the penetrator component 80 is in the form of a cap having a rear portion 86 with an axial rearwardly opening bore 88 therein for receiving a reduced front pin member 90 projecting axially and forwardly on the front end portion 74 of the body 72. Preferably, the reduced front pin member 90 is securely received in the rearwardly opening bore 88 with a press fit. The reduced front pin member 90 may be roughened, knurled or formed with peripheral nicks to enhance the retention of the penetrator component on the pin member 90. Other means may be employed for securely mounting a separate penetrator component or cap 80 on the front end portion 74 of the body 72.

As shown, the penetrator component or cap 80 has a diameter greater than the diameter of the body 72, whereby the mass of the penetrator component 80 is increased to afford enhanced penetration. The increased mass of the penetrator component 80 also enhances the flight stability of the flechette 70. The lightness of the plastic fin component 22 also contributes to the flight stability of the flechette 70.

Typically, the flechette 70 has a greater weight and size than the flechette 10. For example, the flechette 10 may have a weight of 55 grains, while the flechette 70 may have a weight of approximately 120 grains. However, the weight and size of both flechettes 10 and 70 can be varied.

The reduced front pin member 90 on the body 72 may be machined by automatic machinery, such as an automatic screw machine. The penetrator component 80 may be machined from substantially cylindrical rod or bar stock. The blunt penetrating point 82 and the axial bore 88 may be machined by automatic machinery, such as an automatic screw machine. Subsequent to the machining operations, the penetrator component 80 may be hardened by known or suitable heat treatment procedures.

Due to the bluntness of the penetrating point 82, the full diameter of the penetrator component 80 is quickly engaged with a target whereby the point 82 is adequately supported by the penetrator component 80 so that shattering of the penetrator component 80 will not be at all likely to occur when the penetrating point 82 strikes the target at a high velocity. The bluntness of the penetrating point 82 enables the penetrator component 82 to penetrate a hard target, such as surface hardened armor used on aircraft to protect vital components.

However, the bluntness of the penetrating point 82 increases the air drag or friction on the flechette 70 when the flechette is fired at a high velocity.

Figure 7:
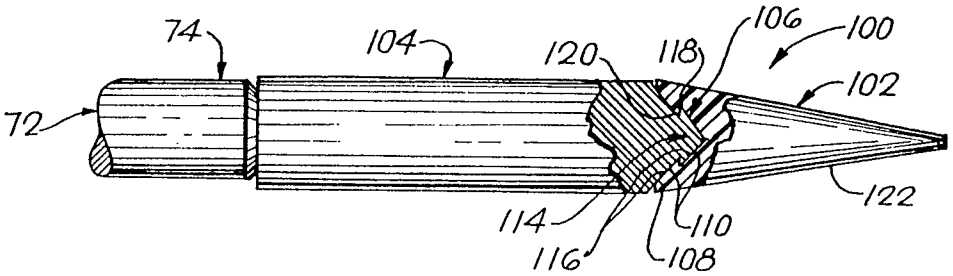
FIG. 7 is a fragmentary enlarged elevational view of another modified flechette, to be described as a third illustrative embodiment of the present invention.
Figure 4:
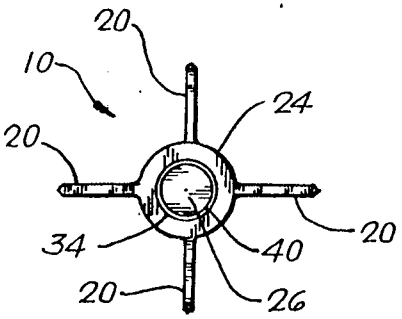
FIG. 4 is a rear elevational view of the flechette, taken generally as indicated by the line 4—4 in FIG. 1.

FIG. 7 shows a third illustrative embodiment of the present invention in the form of a third modified flechette 100 having a sharply pointed nose piece 102 for reducing the air drag on the flechette 100. In all respects, the construction of the nose piece 102 is the same as that of the elongated generally conical nose piece 50, previously described in connection with FIGS. 1-3, so that the previous description is fully applicable to the nose piece 102. The components associated with the nose piece 102 are also the same as previously described.

The flechette 100 has a separate penetrator component or cap 104 which is the same as the penetrator component 80 of FIGS. 5 and 6, except that provision is made for securing the nose piece 102 to the penetrator component 104. Thus, the penetrator component 104 has point means 106 comprising a blunt penetrating point 108 with an external generally conical surface 110. Connecting means 112 are provided for securely mounting the nose piece 102 on the penetrator component 104. As before, the generally conical nose piece 102 is formed with a rearwardly facing axial recess 114 having an internal generally conical surface 116 which is fully engageable with the external generally conical surface 110 of the penetrating point 108. As illustrated, the connecting means 112 comprise first and second interlocking annular flanges on the external generally conical surface 110 of the penetrating point 108 and the internal generally conical surface 116 of the rearwardly facing recess 114 in the nose piece 102. The annular flanges 118 and 120 are generally barb-shaped in cross section and are adapted to snap together in interlocking engagement when the nose piece 102 is pressed rearwardly against the blunt penetrating point 108 on the penetrator component 104. The nose piece 102 is preferably made of glass filled nylon or some other suitable resinous plastic material which is sufficiently elastic to allow the second annular flange 120 and the adjacent portions of the nose piece 102 to expand and contract resiliently, as the flange 120 on the nose piece 102 is pressed rearwardly past the flange 118 on the penetrating point 108. Other means could be provided to secure the nose piece 102 to the penetrator component 104.

As before, the nose piece 102 has an external generally conical surface 122 which tapers much more gradually than does the blunt generally conical surface 110 of the penetrating point 108. Thus, the provision of the nose piece 102 reduces the air drag on the flechette 100, compared with the air drag that would be produced by the blunt, abruptly tapering conical surface 110 of the penetrating point 108. Due to the reduced air drag, the flechette 100 strikes a target with a greater velocity after the flechette has been fired at high velocity from a gun or warhead.

When the nose piece 102 strikes a target, the nose piece shatters or disintegrates immediately, because of its resinous plastic material. The blunt penetrating point 108 strikes the target with virtually no reduction in velocity due to the shattering of the nose piece 102. The blunt penetrating point 108 is adequately supported by the penetrator component 104 and the body 72 so that the impact of the penetrator component 104 causes the blunt point 108 to penetrate the target, without causing the penetrator component 104 or the body 72 to shatter or break up.

The provision of the heavy penetrator component 104 and the gradually tapered conical nose piece 102 improves the flight stability of the flechette 100. It will be understood that the flechette 100 includes the same fin component 22 and the associated components at the rear end of the body 72, as described and illustrated in connection with the flechettes 10 and 70 of FIGS. 1-6. For convenience of illustration, FIG. 7 shows only the front end portion 74 of the body 72 as well as the penetrator component 104 and the nose piece 102. Otherwise, the flechette 100 is the same as the flechette 70 illustrated in FIGS. 5 and 6. The previous description is fully applicable to the flechette 100.

The preferred and most advantageous application of the flechettes of the present invention is believed to reside in the provision of multiple small flechettes, ranging in weight from 55 to 120 grains. The multiple small flechettes are carried in a warhead intended for aircraft engagement. Enough flechettes are included in each warhead to provide a virtual cloud of flechettes, thereby insuring that at least some of the flechettes will hit the target aircraft. Such small flechettes, constructed in accordance with the present invention, weigh enough to penetrate the target armor. The flechettes in this range of weights are also very effective against personnel, material, structures, equipment, boats, other vehicles and the like.

The flechettes of the present invention can be fabricated very easily and inexpensively. Such flechettes can be made at least as small as 20 grains in weight. The flechettes can be made much larger and virtually as large as desired, with no upper limit in size. Flechettes several feet in length and having a body diameter of at least one inch are entirely feasible for larger warheads and higher velocity rockets. The construction of the larger flechettes may be the same as described herein. The components are simply scaled upwardly in size, without any change in the configuration of the components or the materials employed.

Other modifications, alternatives and equivalents may be employed without departing from the true spirit and scope of the present invention as described herein and as defined in the following claims.

I claim:

1. A flechette for use as a military projectile, comprising an elongated, generally cylindrical rod-shaped body made of a tough metallic material and having front and rear end portions, fin means forming a plurality of guide fins on said rear end portion, point means forming a blunt, abruptly tapering penetrating point on said front end portion of said body, and an elongated, generally conical nose piece made of a resilient resinous plastic material mold separately from said body and mounted on said blunt, abruptly tapering point on said front end portion of said body for reducing air drag on the flechette, said nose piece having a rearwardly-facing recess therein formed with an internal, abruptly tapering surface corresponding in shape to the abruptly tapering shape of said penetrating point for snugly fitting thereon, said blunt, abruptly tapering penetrating point having an external, annular, generally barb-shaped connecting flange thereon, said nose piece having an internal, annular, generally barb-shaped connecting flange formed thereon in said recess for interlocking with said external connecting flange, said resinous plastic nose piece being resilient and flexible to enable forced assembly of said nose piece on said abruptly tapering penetrating point with said internal connecting flange forced into interlocking engagement with said external connecting flange.

2. A flechette in accordance with claim 1, in which said blunt, abruptly tapering penetrating point on said body and said recess in said nose piece have complementary, generally conical shapes for fitting snugly together when assembled.

3. A flechette according to claim 1, in which said nose piece has a generally conical, gradually tapering external surface for reducing air drag on the flechette, said blunt, abruptly tapering penetrating point being generally conical in shape and being tapered more abruptly than the gradually tapering external surface of said nose piece, said recess is said nose piece being generally conical and abruptly tapering in shape and being complementary in shape with said generally conical, abruptly tapering penetrating point to fit snugly thereon.

4. A flechette according to claim 1, said fin means comprising a fin component securely mounted on said rear end portion of said body, said fin component being made of a resilient, moldable, resinous plastic material and being molded separately from said body, said fin component comprising an axial sleeve member having an axial opening therein for receiving said rear end portion of said body, said guide fins being molded in one piece with said sleeve member, and interlocking flange and groove elements on said sleeve member and on said rear end portion of said body for securely retaining said fin component on said body, said sleeve member being resilient and flexible to enable forced assembly of said sleeve member around said rear end portion of said body with said flange and groove elements forced into interlocking engagement.

5. A flechette for use as a military projectile adapted to be fired at a high velocity from a warhead, said flechette comprising an elongated, generally rod-shaped body made of a tough metallic material and having front and rear portions, point means forming a blunt abruptly tapering penetrating point on said front portion of said body, a fin component securely mounted on said rear portion of said body, said fin component being made of a resilient, moldable, resinous plastic material and being molded separately from said body, said fin component comprising an axial sleeve member having an axial opening therein for receiving said rear portion of said body, said fin component having a plurality of guide fins molded in one piece with said axial sleeve member and projecting directly radially outwardly therefrom, and interlocking flange and groove elements on said sleeve member of said fin component and on said rear portion of said body for securely retaining said fin component on said body, said sleeve member being resilient and flexible to enable forced assembly of said sleeve member around said rear portion of said body with said flange and groove elements forced into interlocking engagement, said body and said sleeve member having respective extreme rear ends, said flange element being in the form of a single annular flange molded in one piece with said sleeve member and projecting inwardly on said sleeve member closely adjacent said extreme rear end thereof, said annular flange projecting radially inwardly into said axial opening in said sleeve member, said groove element being in the form of a single annular groove formed in said rear portion of said body closely adjacent said extreme rear end thereof for securely receiving said inwardly projecting annular flange on said sleeve member of said fin component.

6. A flechette for use as a military projectile, comprising an elongated, generally cylindrical rod-shaped body made of a tough metallic material and having front and rear end portions, fin means forming a plurality of guide fins on said rear end portion of said body, point means forming a blunt, abruptly tapering penetrating point on said front end portion of said body, and an elongated, generally conical nose piece made of a resilient resinous plastic material molded separately from said body and mounted on said blunt, abruptly tapering point on said front end portion of said body, said nose piece having an external, generally conical surface tapering substantially more gradually than said blunt, abruptly tapering penetrating point on said body for reducing air drag on the flechette, said nose piece having a rearwardly-facing recess formed with an internal, abruptly tapering surface complementary in shape relative to said abruptly tapering penetrating point for snugly fitting thereon, said blunt, abruptly tapering point having an external, annular, generally barb-shaped connecting flange thereon, said nose piece having an annular, generally barb-shaped internal connecting flange formed thereon in said recess for interlocking with said external connecting flange, said resinous plastic nose piece being resilient and flexible and adapted to be resiliently stretched to enable forced assembly of said nose piece on said abruptly tapering penetrating point with said internal connecting flange forced into interlocking engagement with said external connecting flange, said fin means comprising a fin component securely mounted on said rear end portion of said body, said fin component being made of a resilient, moldable, resinous plastic material and being molded separately from said body, said fin component comprising an axial sleeve member having an axial opening therein for receiving said rear end portion of said body, said guide fins being molded in one piece with said sleeve member, and interlocking annular flange and groove elements on said sleeve member and on said rear end portion of said body for securely retaining said fin component on said body, said sleeve member being resilient and flexible and adapted to be resiliently stretched to enable forced assembly of said sleeve member around said rear end portion of said body with said flange and groove elements forced into interlocking engagement.

7. A flechette in accordance with claim 6, in which said blunt, abruptly tapering penetrating point on said body and said recess in said nose piece have complementary, generally conical shapes for fitting snugly together when assembled.

8. A flechette according to claim 7, in which said interlocking flange and groove elements comprise a single annular flange molded in one piece with said sleeve member and projecting inwardly thereon into said axial opening therein, and a single external annular groove formed in said rear end portion of said body for snugly receiving said internal annular flange on said sleeve member.

* * * * *